US007793934B2

(12) United States Patent
Matsumoto

(10) Patent No.: US 7,793,934 B2
(45) Date of Patent: Sep. 14, 2010

(54) SHEET CONVEYING DEVICE AND IMAGE FORMING APPARATUS

(75) Inventor: Yuzo Matsumoto, Abiko (JP)

(73) Assignee: Canon Kabushiki Kaisha (JP)

( * ) Notice: Subject to any disclaimer, the term of this patent is extended or adjusted under 35 U.S.C. 154(b) by 151 days.

(21) Appl. No.: 11/959,934

(22) Filed: Dec. 19, 2007

(65) Prior Publication Data

US 2008/0157465 A1 Jul. 3, 2008

(30) Foreign Application Priority Data

Dec. 27, 2006 (JP) ..... 2006-352938

(51) Int. Cl.
*B65H 5/02* (2006.01)
*B65H 7/02* (2006.01)

(52) U.S. Cl. ..... 271/272; 271/265.01

(58) Field of Classification Search ..... 271/264, 271/265.01–265.03, 272–274
See application file for complete search history.

(56) References Cited

U.S. PATENT DOCUMENTS 5,172,900 A * 12/1992 Uno et al. ..... 271/125
6,499,734 B1 * 12/2002 Tranquilla ..... 271/10.03
7,389,083 B2 * 6/2008 Sugimoto ..... 399/388
2007/0109586 A1 * 5/2007 Yamada et al. ..... 358/1.14
2008/0232880 A1 * 9/2008 Noguchi et al. ..... 399/397
2009/0184457 A1 * 7/2009 Tsukamoto et al. ..... 271/10.03

FOREIGN PATENT DOCUMENTS

JP 03259846 * 11/1991
JP 09-156797 A 6/1997

* cited by examiner

*Primary Examiner*—Patrick Mackey
*Assistant Examiner*—Patrick Cicchino
(74) *Attorney, Agent, or Firm*—Rossi, Kimms & McDowell LLP

(57) ABSTRACT

A sheet conveying device which is capable of stably conveying a sheet, irrespective of the material of the sheet. A first conveying roller pair nips and conveys a sheet. A drive motor drives the first conveying roller pair. An encoder detects the rotational speed of the first conveying roller pair. A first nip pressure-adjusting unit controls the nip pressure of the first conveying roller pair, and a CPU controls the first nip pressure-adjusting unit according to a change in the rotational speed of the first conveying roller pair detected by the encoder during sheet conveyance.

7 Claims, 15 Drawing Sheets

FIG. 5

| SPEED DIFFERENCE ΔV(= Vref - V1)(mm/s) | IN TERMS OF NIP PRESSURE (gf) | ROLLER-TO-ROLLER DISTANCE CHANGE AMOUNT ΔL(mm) |
|---|---|---|
| 1～5 | 50 | 0.1 |
| 6～10 | 100 | 0.2 |
| 11～15 | 150 | 0.3 |
| 16～20 | 200 | 0.4 |
| 21～25 | 250 | 0.5 |

FIG. 6

| SPEED DIFFERENCE ΔV(= Vref - V1)(mm/s) | IN TERMS OF NIP PRESSURE (gf) | CURRENT CHANGE AMOUNT ΔI(A) |
|---|---|---|
| 26～30 | 300(50) | 0.1 |
| 31～35 | 350(100) | 0.2 |
| 36～40 | 400(150) | 0.3 |
| 41～45 | 450(200) | 0.4 |
| 46～50 | 500(250) | 0.5 |

FIG. 7

| SPEED DIFFERENCE ΔV(= Vref - V1)(mm/s) | IN TERMS OF NIP PRESSURE (gf) | CURRENT CHANGE AMOUNTΔI(A) |
|---|---|---|
| 1～5 | 50 | 0.1 |
| 6～10 | 100 | 0.2 |
| 11～15 | 150 | 0.3 |
| 16～20 | 200 | 0.4 |
| 21～25 | 250 | 0.5 |

FIG. 8

| SPEED DIFFERENCE ΔV(= Vref - V1)(mm/s) | CONVEYING SPEED V(mm/s) |
|---|---|
| 1～5 | 0.99*V0 |
| 6～10 | 0.98*V0 |
| 11～15 | 0.97*V0 |
| 16～20 | 0.96*V0 |
| 21～25 | 0.95*V0 |

*FIG. 9*

WARNING

PRODUCTIVITY AUTOMATICALLY CHANGES FROM 60 ppm TO 58 ppm.
SERVICE CALL IS CURRENTLY TRANSFERRED VIA NETWORK

NO PROBLEM ABOUT SHEET FEEDING

| SPEED DIFFERENCE ΔV(= Vref - V1)(mm/s) | PASSABLE SHEET BASIS WEIGHT (g/mm2) |
|---|---|
| 1～5 | ～400 |
| 6～10 | ～350 |
| 11～15 | ～300 |
| 16～20 | ～250 |
| 21～25 | 200 |

SHEET CONVEYING DEVICE AND IMAGE FORMING APPARATUS

BACKGROUND OF THE INVENTION

1. Field of the Invention

The present invention relates to a sheet conveying device, and an image forming apparatus, such as a copying machine or a printer, equipped with the sheet conveying device.

2. Description of the Related Art

Conventionally, in a sheet conveying device for conveying sheets (recording sheets) using roller pairs, if load fluctuation is large when the leading end of a sheet is brought into contact with a roller pair, loss of synchronism of a motor for driving the roller pair can occur, which damages the leading end of the sheet. This phenomenon is likely to occur when a stiff (rigid) sheet is used.

To solve this problem, a technique has already been proposed in which a roller pair is controlled such that the two rollers are separated with a predetermined distance therebetween immediately before a sheet is brought into contact with the rollers, so as to reduce impact between the sheet and the roller pair (see Japanese Laid-Open Patent Publication (Kokai) No. H09-156797).

However, the above-mentioned conventional technique in which contact and separation between the two rollers of the roller pair repeatedly take place is considered to be disadvantageous in that:

(1) The repetition of contact and separation is not suitable for high-speed sheet conveyance;

(2) Sheets can be damaged due to contact and separation between the two rollers;

(3) Since the rollers bound, it takes a certain time period before the rollers are stabilized to provide an appropriate conveying force; and (4) Load fluctuation is increased when the rollers come into contact with each other.

SUMMARY OF THE INVENTION

The present invention provides a sheet conveying device which is capable of stably conveying a sheet, irrespective of the material of the sheet, and an image forming apparatus equipped with the sheet conveying device.

In a first aspect of the present invention, there is provided a sheet conveying device comprising a conveying roller pair configured to nip and convey a sheet, a driving unit configured to drive the conveying roller pair, a rotational speed-detecting unit configured to detect a rotational speed of the conveying roller pair, a pressure control unit configured to control a nip pressure of the conveying roller pair, and a main control unit configured to control the pressure control unit according to a change in the rotational speed of the conveying roller pair detected by the rotational speed-detecting unit during sheet conveyance.

The sheet conveying device according to the first aspect of the present invention comprises the conveying roller pair configured to nip and convey a sheet, the driving unit configured to drive the conveying roller pair, the rotational speed-detecting unit configured to detect the rotational speed of the conveying roller pair, and the pressure control unit configured to control the nip pressure of the conveying roller pair. Further, the sheet conveying device comprises the main control unit configured to control the pressure control unit according to a change in the rotational speed of the conveying roller pair detected by the rotational speed-detecting unit during sheet conveyance. With this arrangement, a sheet can be stably conveyed, irrespective of the material of the sheet.

The main control unit can be operable when the rotational speed-detecting unit detects that the rotational speed of the conveying roller pair has become lower than a predetermined rotational speed, during sheet conveyance, to control the pressure control unit in a direction in which the nip pressure is reduced.

The sheet conveying device comprises a storage unit configured to store information on a nip pressure of the conveying roller pair for sheet conveyance, on a sheet type-by-sheet type basis, and the main control unit can control the pressure control unit such that the conveying roller pair provides the nip pressure the information on which is stored in the storage unit, according to a sheet type of the sheet being conveyed.

The main control unit can be operable after the sheet is nipped by the conveying roller pair, to perform control such that the nip pressure controlled by the pressure control unit is changed according to a type of the sheet.

The main control unit can be operable when a nip pressure to be controlled by the pressure control unit is outside a controllable range, to perform control such that a driving force of the driving unit is increased.

The main control unit is operable before or after the sheet is nipped by the conveying roller pair, to perform control such that the nip pressure controlled by the pressure control unit is changed.

In a second aspect of the present invention, there is provided a sheet conveying device comprising a conveying roller pair configured to nip and convey a sheet, a driving unit configured to drive the conveying roller pair, a rotational speed-detecting unit configured to detect a rotational speed of the conveying roller pair, and a main control unit configured to control a driving force of the driving unit according to a change in the rotational speed of the conveying roller pair detected by the rotational speed-detecting unit during sheet conveyance.

In a third aspect of the present invention, there is provided a sheet conveying device comprising a conveying roller pair configured to nip and convey a sheet, a driving unit configured to drive the conveying roller pair, a rotational speed-detecting unit configured to detect a rotational speed of the conveying roller pair, and a main control unit configured to control a speed of the driving unit according to a change in the rotational speed of the conveying roller pair detected by the rotational speed-detecting unit during sheet conveyance.

The sheet conveying device comprises an operating screen, and the main control unit can perform control such that productivity is displayed on the operating screen.

In a fourth aspect of the present invention, there is provided a sheet conveying device comprising a conveying roller pair configured to nip and convey a sheet, a driving unit configured to drive the conveying roller pair, a rotational speed-detecting unit configured to detect a rotational speed of the conveying roller pair, and a main control unit configured to perform control such that a type of a conveyable sheet is limited according to a change in the rotational speed of the conveying roller pair detected by the rotational speed-detecting unit during sheet conveyance.

In a fifth aspect of the present invention, there is provided an image forming apparatus comprising a sheet conveying device, wherein the sheet conveying device comprises a conveying roller pair configured to nip and convey a sheet, a driving unit configured to drive the conveying roller pair, a rotational speed-detecting unit configured to detect a rotational speed of the conveying roller pair, a pressure control unit configured to control a nip pressure of the conveying roller pair, and a main control unit configured to control the pressure control unit according to a change in the rotational speed of the conveying roller pair detected by the rotational speed-detecting unit during sheet conveyance.

The features and advantages of the invention will become more apparent from the following detailed description taken in conjunction with the accompanying drawings.

BRIEF DESCRIPTION OF THE DRAWINGS

FIG. 5 is a diagram useful in explaining the relationship between a speed difference ΔV in a case where Vref>V1 holds and a roller-to-roller distance (ΔL) to be controlled in the sheet conveying device.

FIG. 6 is a diagram showing how the current value of a conveying motor is changed after the roller-to-roller distance having been changed in a case where the speed difference is larger than a predetermined value in the sheet conveying device.

FIG. 7 is a diagram showing how the current value of the conveying motor is changed in a case where the speed difference is larger than the predetermined value in the sheet conveying device.

FIG. 8 is a diagram showing the relationship between the speed difference ΔV in the case where Vref>V1 holds and the current value of the conveying motor in the sheet conveying device.

FIG. 9 is a view illustrating an operating screen on which a warning on a change in productivity is displayed when the sheet conveying speed of the sheet conveying device is changed.

DETAILED DESCRIPTION OF THE PREFERRED EMBODIMENTS

The present invention will now be described in detail with reference to the drawings showing a preferred embodiment thereof.

Figure 1:
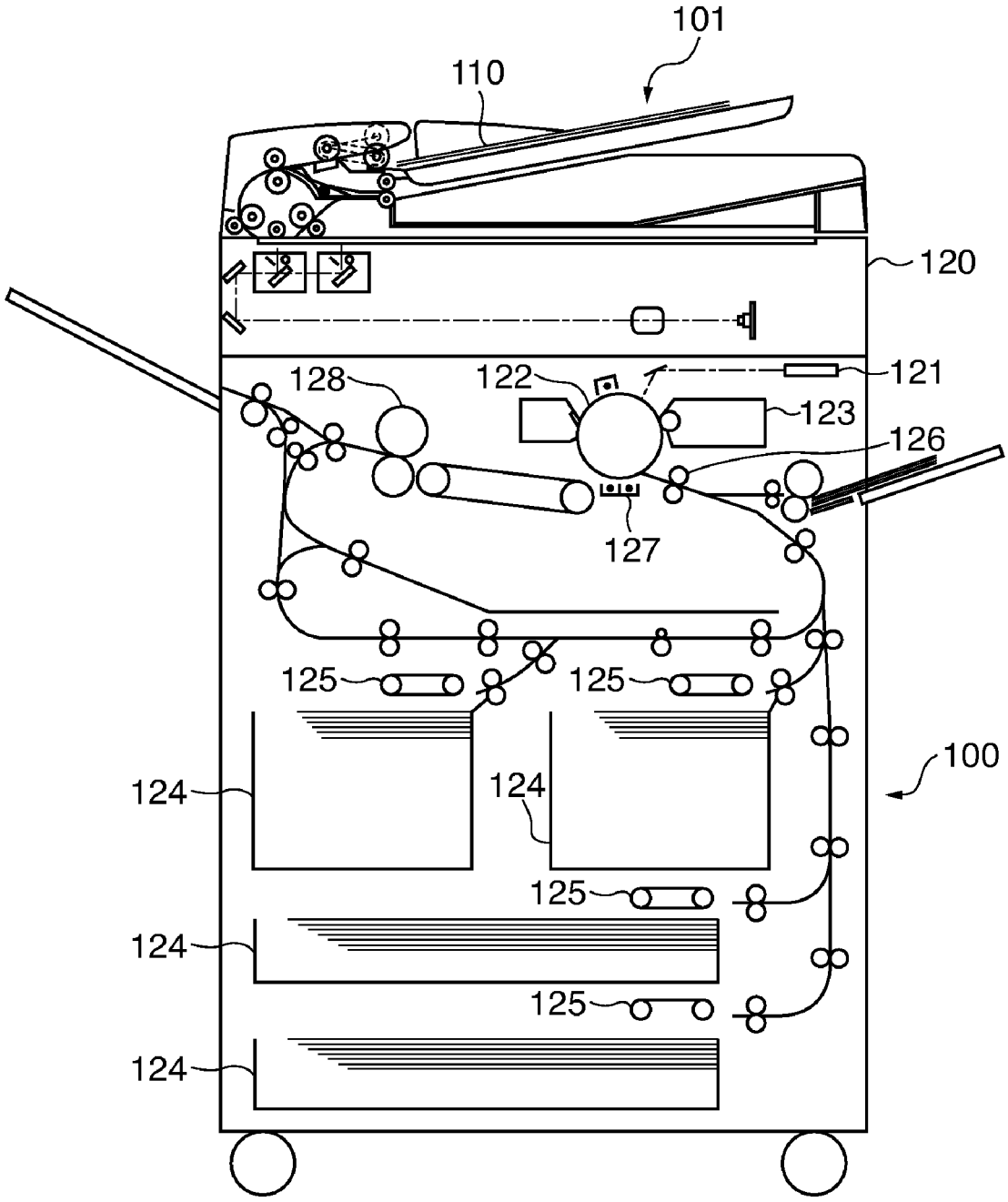
FIG. 1 is a schematic cross-sectional view of an image forming apparatus according to an embodiment of the present invention.

FIG. 1 is a schematic cross-sectional view of an image forming apparatus according to an embodiment of the present invention. As shown in FIG. 1, the image forming apparatus is comprised of an apparatus main unit 100, and an automatic document feeder 101. The other components will be described together with operations thereof.

First, an original is automatically conveyed to a reading position by an original conveying unit 110 of the automatic document feeder 101, and then image information is read from the original by an image reader 120 of the apparatus main unit 100. The read image information is processed by a controller, not shown, and a laser beam is emitted from a laser scanner unit 121 according to a signal generated based on the processed image information, whereby an electrostatic latent image is formed on a photosensitive drum 122.

The electrostatic latent image formed on the photosensitive drum 122 is developed by a developing device 123. On the other hand, a sheet or an OHT sheet contained in an associated sheet container 124 is conveyed by a sheet conveying device including conveying suction belts 125.

Then, the sheet is conveyed to a transfer section 127 in timing made synchronous with formation of a toner image on the photosensitive drum 122 at a registration section 126, and the toner image is transferred onto the sheet in the transfer section 127. Further, the sheet is guided to a fixing roller pair 128, where the unfixed toner image on the sheet is heated and pressed to be fixed on the sheet.

Figure 2:
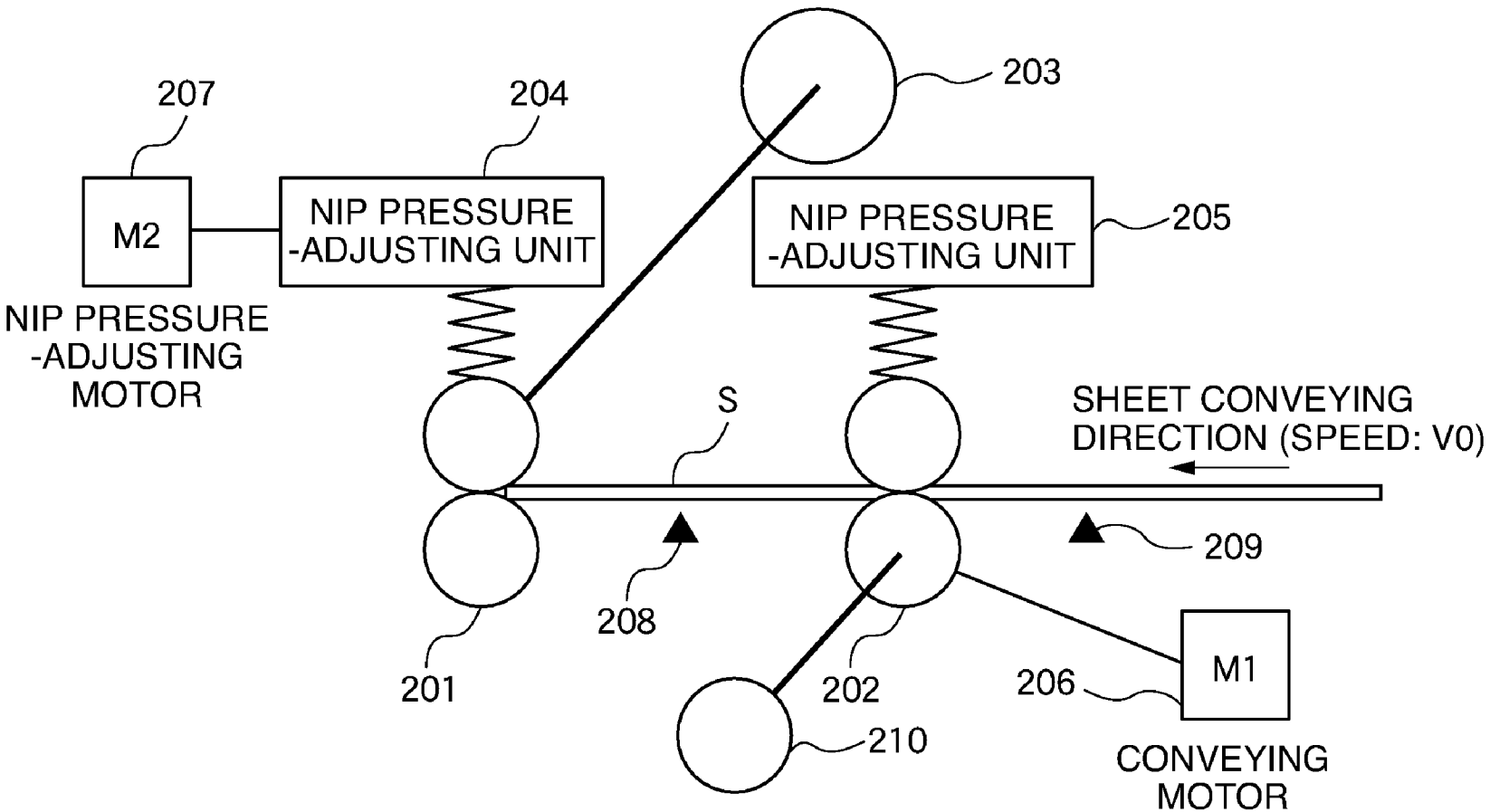
FIG. 2 is a schematic view of a sheet conveying device applied to the image forming apparatus in FIG. 1.

FIG. 2 is a schematic view of the sheet conveying device applied to the image forming apparatus in FIG. 1. As shown in FIG. 2, the sheet conveying device includes two roller pairs, i.e. a first conveying roller pair 201 and a second conveying roller pair 202 (each hereinafter simply referred to as "the roller pair" as deemed appropriate). The first conveying roller pair 201 and the second conveying roller pair 202 apply to all adjacent rollers as components of the image forming apparatus and the sheet conveying device.

An encoder 203 for speed measurement is mounted on the shaft of the first conveying roller pair 201. An encoder 210 for speed measurement is mounted on the shaft of the second conveying roller pair 202. A first nip pressure-adjusting unit 204 adjusts the nip pressure of the first conveying roller pair 201. Similarly, a second nip pressure-adjusting unit 205 adjusts the nip pressure of the second conveying roller pair 202.

A conveying motor 206 drives the second conveying roller pair 202. A nip pressure-adjusting motor 207 adjusts nip pressure. A first sensor 208 and a second sensor 209 detect the position of a sheet S. The sheet conveying unit is controlled such that the sheet S is conveyed in a direction indicated by an arrow in FIG. 2.

Figure 3A:
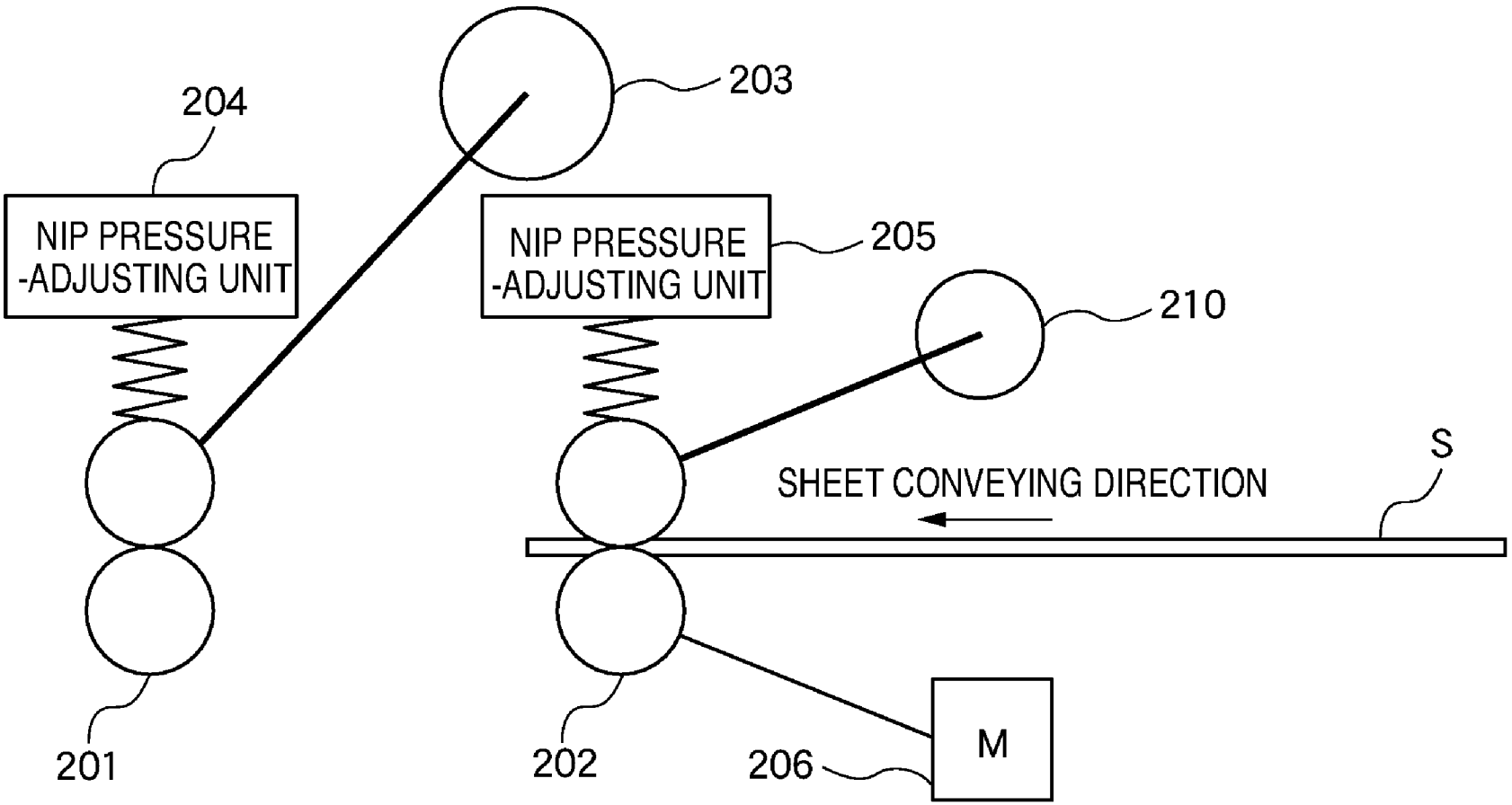
FIGS. 3A to 3C are views illustrating the manner in which a sheet is conveyed at a predetermined speed between a first conveying roller pair and a second conveying roller pair in the sheet conveying device.
Figure 3B:
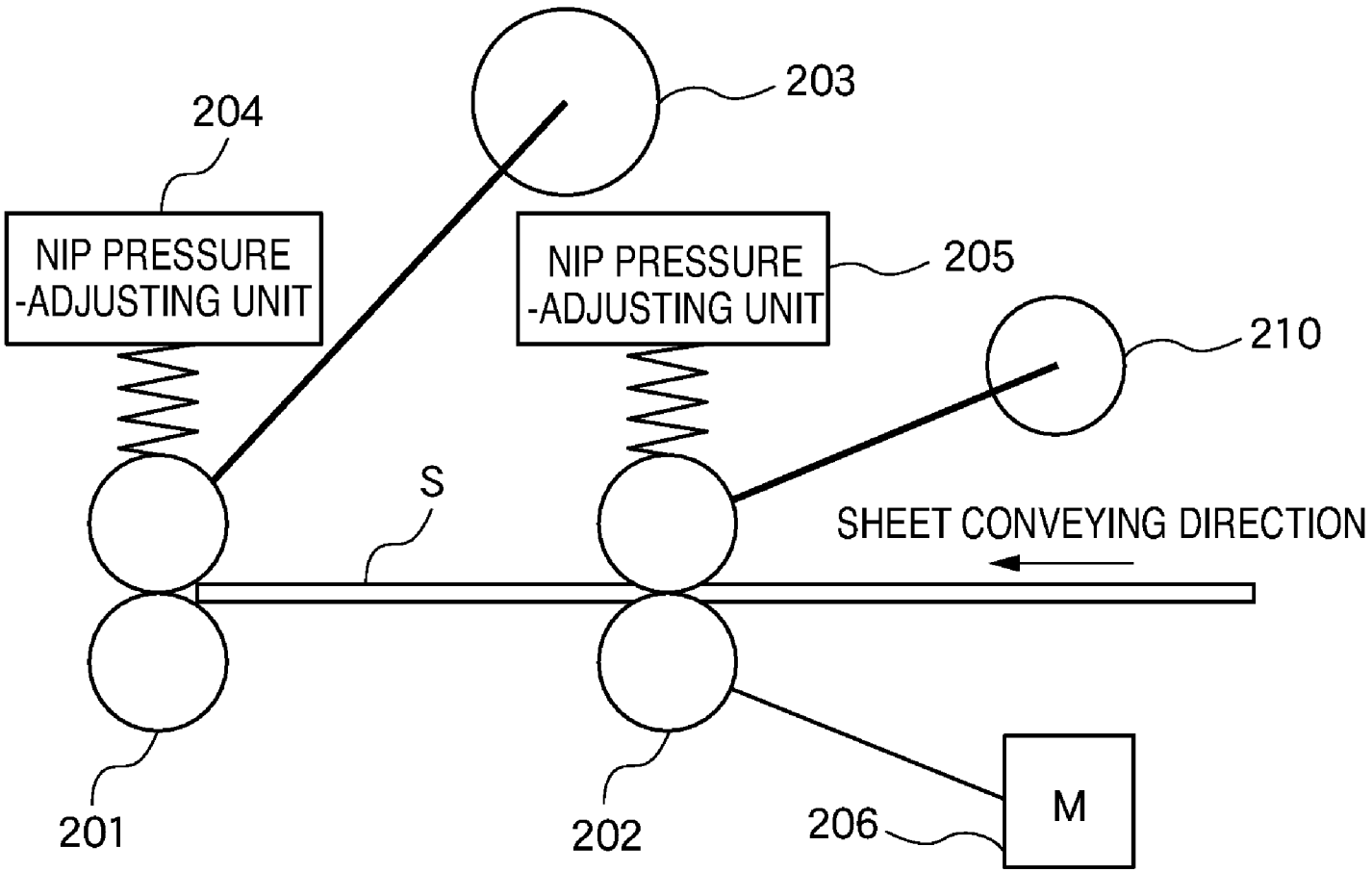
Figure 3C:
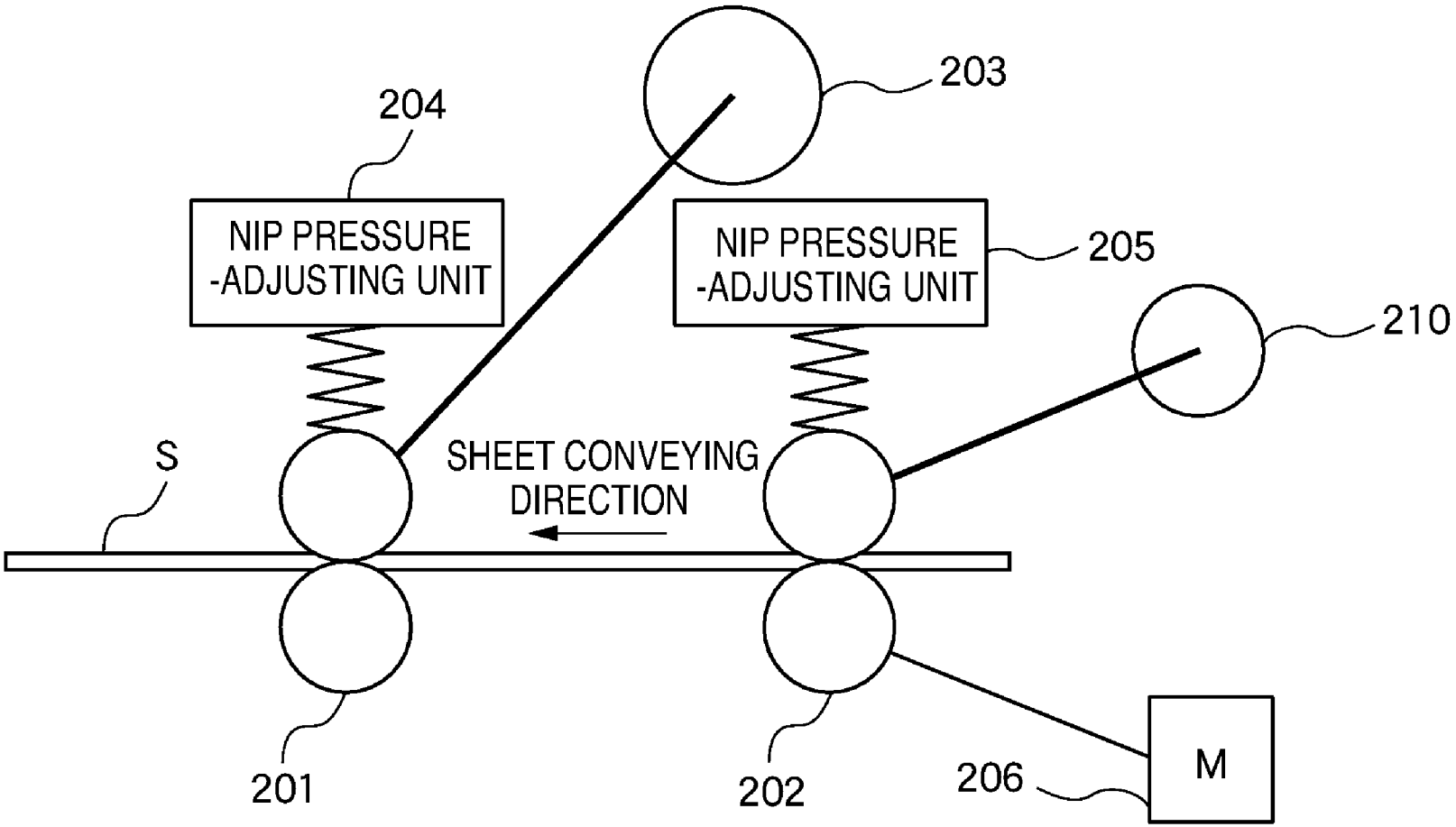

FIGS. 3A to 3C are views illustrating the manner in which a sheet is conveyed at a speed of V0 between the first conveying roller pair and the second conveying roller pair.

Changes in the speed of the first conveying roller pair 201, which occur according to the material, hardness, and thickness of the sheet S when the leading end of the sheet S gets caught in the first conveying roller pair 201 as shown in FIG. 3B will be described with reference to FIGS. 4A and 4B.

Figure 4A:
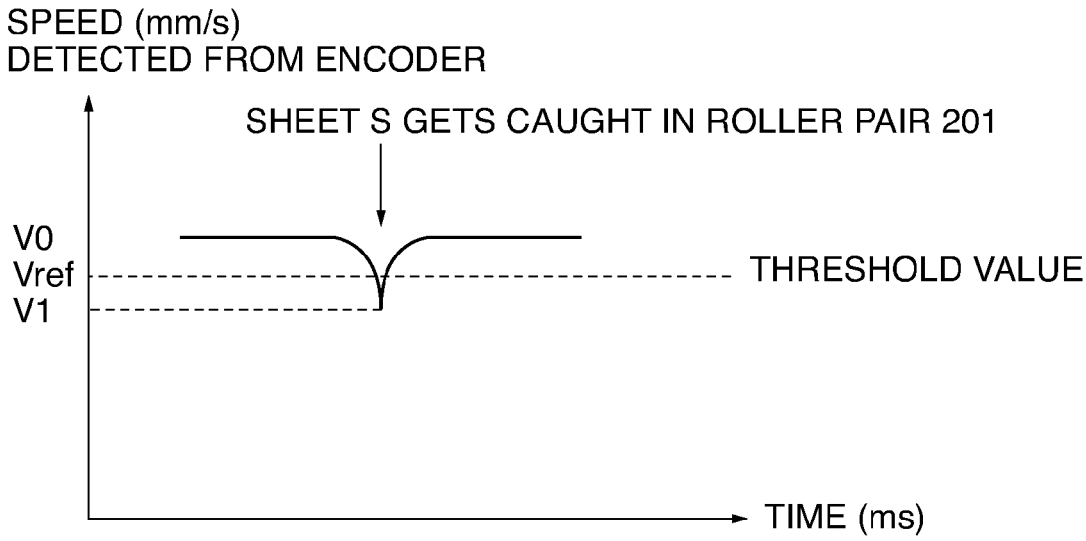
FIGS. 4A and 4B are diagrams useful in explaining changes in the speed of a roller pair, which occur according to the material, hardness, and/or thickness of a sheet S when the leading end of the sheet S comes into contact with the roller pair in the sheet conveying device.
Figure 4B:
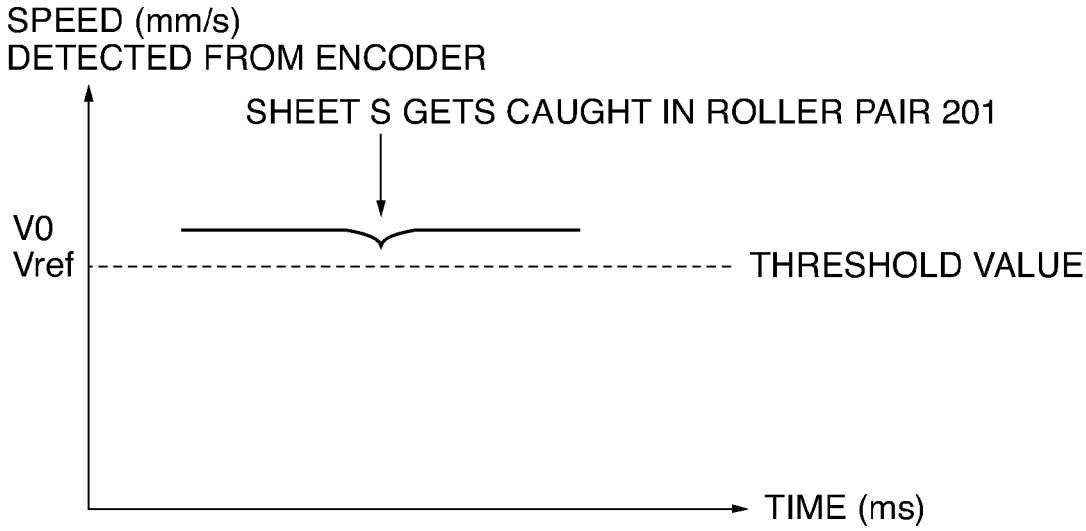

Referring to FIGS. 4A and 4B, the ordinate represents values obtained by converting the rotational speed of one roller of the roller pair 201 detected by a sensor 306, described hereinafter with reference to FIG. 12, using the encoder 203, into the speed of the currently conveyed sheet S, and the abscissa represents elapsed time. FIG. 4A shows a change in speed in a case where a sheet S of a material having a high hardness or a large basis weight ($g/m^2$), such as a sheet having a basis weight of 300 $g/m^2$, is conveyed. In the case where such a sheet S is conveyed, load fluctuation caused when the leading end of the sheet S gets caught in the roller pair 201 is large, and hence a change in the rotational speed of the rollers is also large.

FIG. 4B shows a change in speed in a case where a sheet S of a material having a low hardness or a small basis weight ($g/m^2$), such as a sheet having a basis weight of 52 $g/m^2$, is conveyed. In the case where such a sheet S is conveyed, load fluctuation caused when the leading end of the sheet S gets caught in the roller pair 201 is small, and hence a change in the rotational speed of the rollers is also small.

It is assumed that when a sheet having a basis weight of e.g. 300 $g/m^2$ is conveyed, the value obtained by converting the rotational speed of one roller of the roller pair 201 detected using the encoder 203 by the sensor 306, described hereinafter, is reduced to V1, as shown in FIG. 4A. A symbol Vref in FIG. 4A represents a threshold value provided for the speed change. The threshold value Vref is stored in a memory 303, described hereinafter with reference to FIG. 12, as a reference value, and when a conveying speed V becomes smaller than the threshold value Vref, it is determined that the conveying speed V cannot ensure normal conveyance due to damage to the sheet S or an increase in load applied to the drive system.

If Vref≦V1 holds, it is determined that normal conveyance is ensured. If Vref>V1 holds, it is determined that normal conveyance is not ensured, and the distance between the two rollers of the roller pair 201 is adjusted by the first nip pressure-adjusting unit 204. The nip pressure between the rollers may be detected by a pressure detecting unit, not shown, including a sensor, such as a pressure sensor, and other pressing means.

The relationship between a speed difference (ΔV=Vref−V1) in a case where Vref>V1 holds and a distance (ΔL) between the two rollers of the roller pair 201 to be controlled will be described with reference to FIG. 5. A table shown in FIG. 5 is stored in the memory 303 described hereinafter with reference to FIG. 12. For example, when the speed difference is in a range of 1 to 5 mm/s, the amount of change (amount of increase) in the distance between the two rollers of the roller pair 201 to be controlled is 0.1 mm, which is equivalent to 50 gf in terms of the amount of reduction in the nip pressure.

Similarly, when the speed difference is 6 to 10 mm/s, the amount of change (amount of increase) in the distance between the two rollers of the roller pair 201 to be controlled is 0.2 mm, which is equivalent to 100 gf in terms of the amount of reduction in the nip pressure.

The first nip pressure-adjusting unit 204 is controlled such that normal sheet conveyance is performed according to the table. It is assumed that the roller-to-roller distance ΔL appearing in FIG. 5 is generally controlled such that the two rollers of the roller pair 201 move in respective directions in which they are separated from each other (i.e. respective directions in which the distance ΔL increases).

For example, even if the distance between the two rollers of the roller pair 201 is changed to 0.5 mm, as shown in FIG. 5, the nip pressure between the rollers to be controlled exceeds 250 gf, which means that normal conveying pressure cannot be obtained, control is performed such that the driving force of the conveying motor 206 is increased.

The term "driving force" means the conveying torque of the drive system, and when controlling the driving force, the current value of the conveying motor 206 is mainly controlled. In a case where the nip pressure is controlled according to the table shown in FIG. 5, the setting of the current value of the conveying motor 206 is fixed, that is, it is assumed that the current value is set to 1.0 A.

As shown in FIG. 6, when the speed difference is in a range of 26 to 30 mm/s, the amount of change in the distance between the two rollers of the roller pair 201 is fixed to a maximum change amount of 0.5 mm, and control is performed such that the current value is increased by 0.1 A to 1.1 A with respect to 50 (=300−250) gf in terms of the nip pressure equivalent to the speed difference beyond the range in FIG. 5.

Further, when the speed difference is in a range of 31 to 35 mm/s, the amount of change in the distance between the two rollers of the roller pair 201 is fixed to the maximum change amount of 0.5 mm, and control is performed such that the current value is increased from by 0.2 A to 1.2 A with respect to 100 (=350−250) gf in terms of the nip pressure equivalent to the speed difference beyond the range in FIG. 5.

Although in the above described control, the first nip pressure-adjusting unit 204 and the conveying motor 206 are used differently depending on the stage in the control, only the current value of the conveying motor 206 may be controlled from the start as shown in FIG. 7.

Alternatively, control may be performed such that the conveying speed V of a sheet S (i.e. the rotational speed of the conveying motor 206) is changed according to the speed difference, as shown in FIG. 8. For example, when the speed difference is in a range of 1 to 5 mm/s, control is performed such that the conveying speed becomes equal to 0.99*V0, and when the speed difference is in a range of 6 to 10 mm/s, control is performed such that the conveying speed becomes equal to 0.98*V0.

When control is performed such that the conveying speed V of a sheet S is changed, a warning on a change in productivity is displayed on an operating screen. Further, control may be performed such that when the productivity is lowered, a notification of the fact is sent to a call center or the like via a network.

Figures 10, 11:
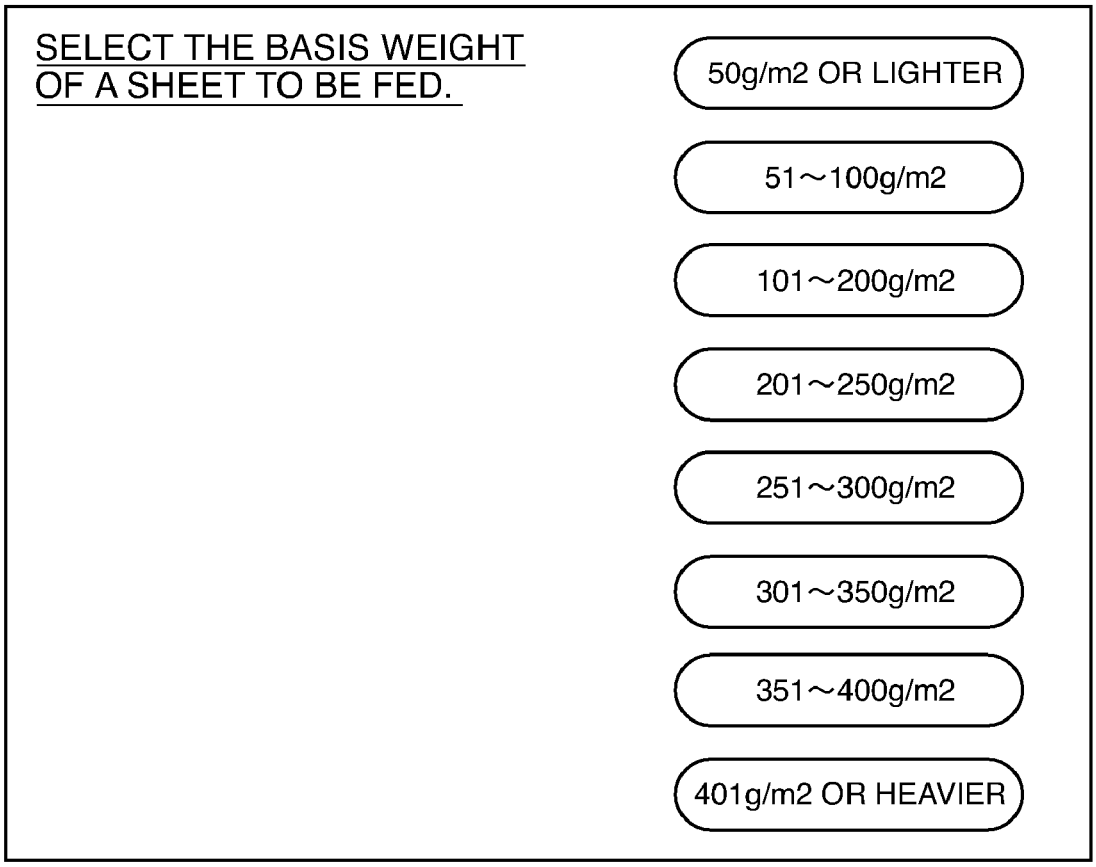
FIG. 10 is a diagram showing the relationship between the speed difference ΔV in the case where Vref>V1 holds and passable sheet basis weight in the sheet conveying device.
FIG. 11 is a view illustrating an operating screen for use in selecting a sheet to be fed.

Further, control may be performed such that a passable sheet material (basis weight) is limited according to the speed difference as shown in FIG. 10. For example, when the speed difference is not larger than 0, a sheet S of any material (basis weight) can be passed.

When the speed difference is in a range of 1 to 5 mm/s, the passable sheet basis weight is limited to 400 $g/mm^2$. Further, when the speed difference is in a range of 6 to 10 mm/s, the passable sheet basis weight is limited to 350 $g/mm^2$.

It should be noted that determination for the above-mentioned control may be performed after test feed of one sheet S or during a normal copy operation. Alternatively, a value of setting stored in the memory 303, described hereinafter, may be set by selecting a sheet S to be fed from an operating screen shown in FIG. 11 by way of example.

Control may be performed such that the material and the like of a sheet to be conveyed are determined by a determination unit, not shown, for determining the material or basis weight of a sheet, and a value of setting stored in the memory 303 is set according to the determination by the determination unit. The priorities in the control are in the order of the roller nip pressure (roller-to-roller distance), the motor current value, and the conveying speed.

Figure 12:
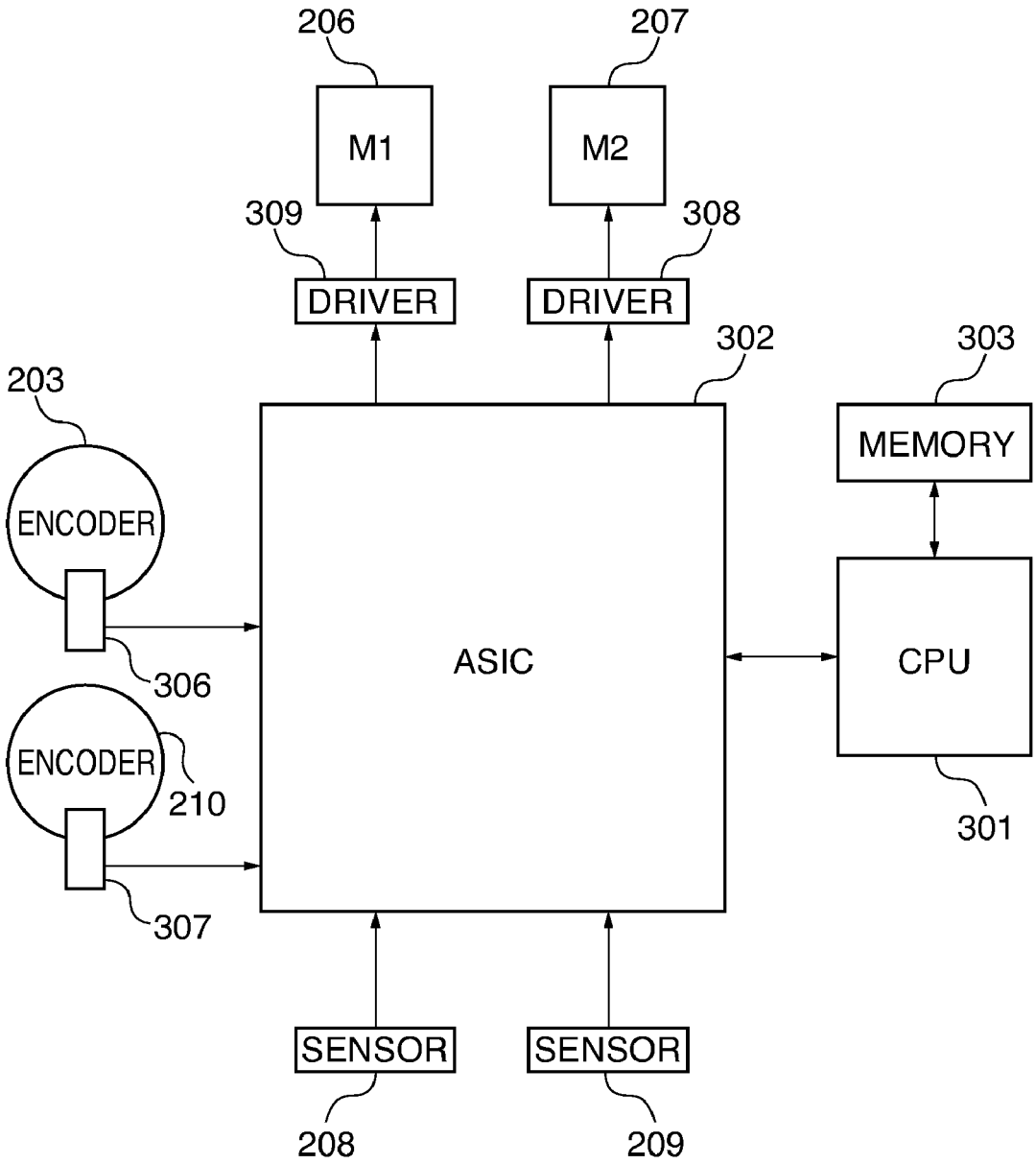
FIG. 12 is a block diagram of a control circuit of the sheet conveying device.

FIG. 12 is a block diagram of a control circuit of the sheet conveying device in FIG. 2. As shown in FIG. 12, a CPU 301 for controlling the sheet conveying device is connected to a dedicated ASIC (Application-Specific Integrated Circuit)

302 for driving loads, including motors, of the sheet conveying device and the memory 303.

The memory 303 stores the threshold value Vref of the conveying speed, the roller-to-roller distance control table for use in controlling the distance between the two rollers of the roller pair 201 according to the speed difference, the current control table for controlling the current value of the conveying motor 206 according to the speed difference, a conveying speed table, a passable sheet material table, and so forth.

The ASIC 302 issues a drive start command to each of drive circuits for driving the respective loads of the sheet conveying device. Further, the ASIC 302 is configured to be capable of constantly measuring the rotational speeds of the respective roller pairs 201 and 202 by detecting rotation signals from the encoders 203 and 210 mounted to the respective roller pairs 201 and 202, by the sensors 306 and 307, respectively.

The CPU 301 cooperates with the ASIC 302 and the memory 201 to control a nip pressure-adjusting motor driver 308 based on the rotational speed change amount of the roller pair 201 so as to control the nip pressure-adjusting motor 207. Similarly, the CPU 301 cooperates with the ASIC 302 and the memory 201 to control a conveying motor driver 309 so as to control the conveying motor 206 for the roller pair 202 to change the speed and current value of the motor. The first and second sensors 208 and 209 are also connected to the ASIC 302.

Although in the sheet conveying device according to the present embodiment, the loads, such as the motors and fans, are controlled by the dedicated ASIC 302, it is to be understood that the CPU may directly control the loads.

Figure 13:
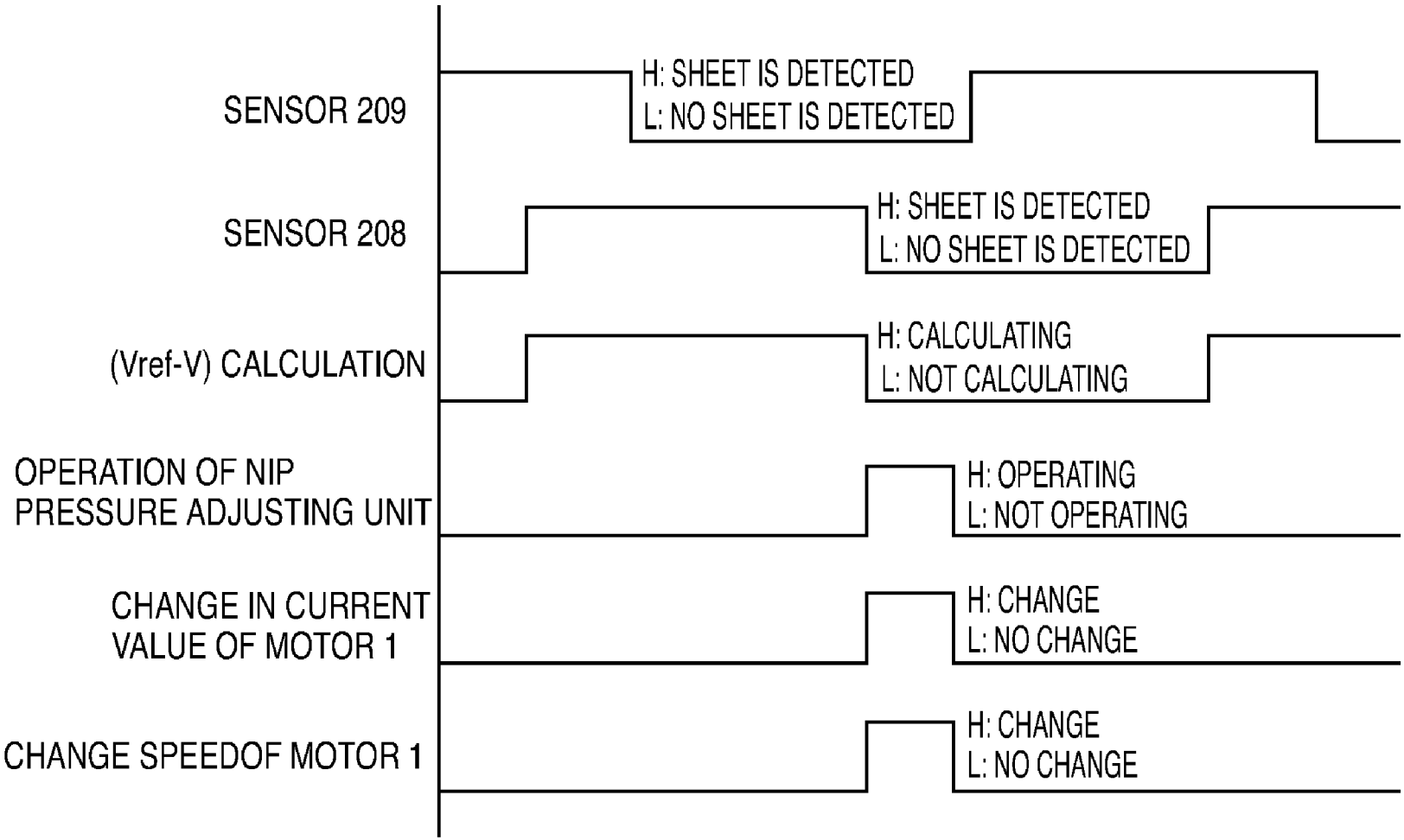
FIG. 13 is a timing diagram useful in explaining operations of respective parts controlled according to a first control method.

A first control method will be described with reference to a timing diagram in FIG. 13.

Now, let it be assumed that a sheet S is being conveyed at a predetermined speed. The sheet S blocks light to the second sensor 209, and then blocks light to the first sensor 208 after the lapse of a predetermined time period. Upon blocking of light to the first sensor 208 by the sheet S, control is performed such that calculation of the sheet conveying speed is carried out using the encoder 203.

Then, based on the result of the calculation of the sheet conveying speed, control is performed such that operation of the nip pressure-adjusting unit 204, changing of the current value of the conveying motor 206 (motor 1), and changing of the speed of the motor 1 are executed in synchronism with the trailing edge of a signal from the first sensor 208

The leading end of the sheet S gets caught in the roller pair 201 when a predetermined time period elapses after the rise of the signal from the first sensor 208. For this reason, control may be performed such that at a time point when a change in speed amount at that time is calculated, the operation of the nip pressure-adjusting unit 204, changing of the current value of the motor 1, and changing of the speed of the motor 1 are executed.

It can occur, depending on the result of the calculation of the sheet conveying speed, that the operation of the nip pressure-adjusting unit 204, the changing of the current value of the motor 1, and the changing of the speed of the motor 1 are not executed. In this case, respective control signals of them are all held low as shown in the timing diagram in FIG. 13.

Figure 14:
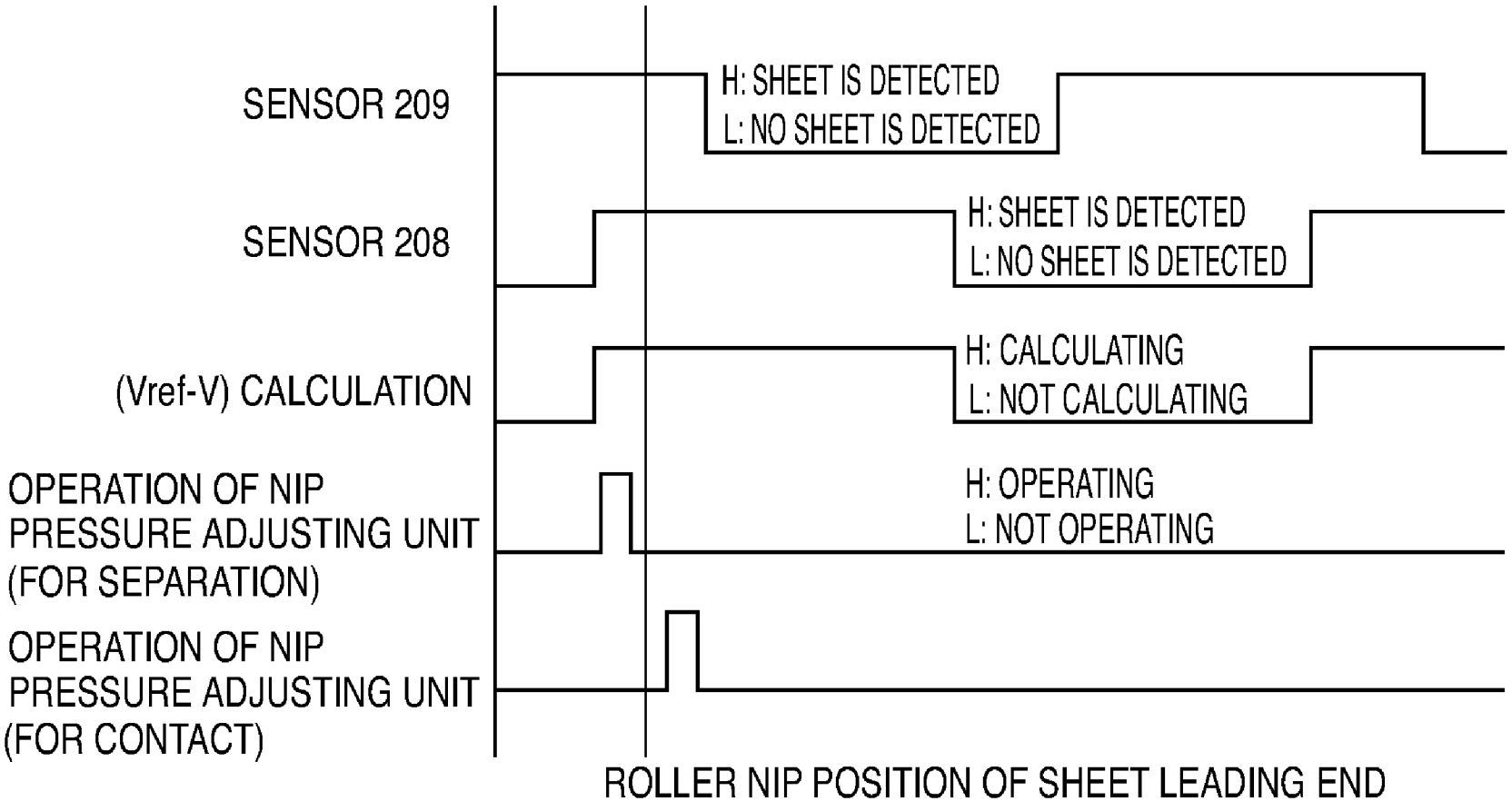
FIG. 14 is a timing diagram useful in explaining operations of respective parts controlled according to a second control method

Next, a second control method will be described with reference to FIG. 14. First, the material and basis weight of a sheet S to be conveyed are determined by a determination unit, not shown. When the sheet S blocks light to the first sensor 208, control is performed such that the calculation of the sheet conveying speed is carried out using the encoder 203. At the same time, an operation for separating the two rollers of the roller pair 201 by the nip pressure-adjusting unit 204 is started. The operation for separating them may be executed earlier.

Then, after the leading end of the sheet S is nipped, an operation for bringing the two rollers of the roller pair 201 into contact with each other by the nip pressure-adjusting unit 204 is started, and the nip pressure is determined by the determination unit, not shown, based on the determined material and basis weight of the sheet S.

Figure 15:
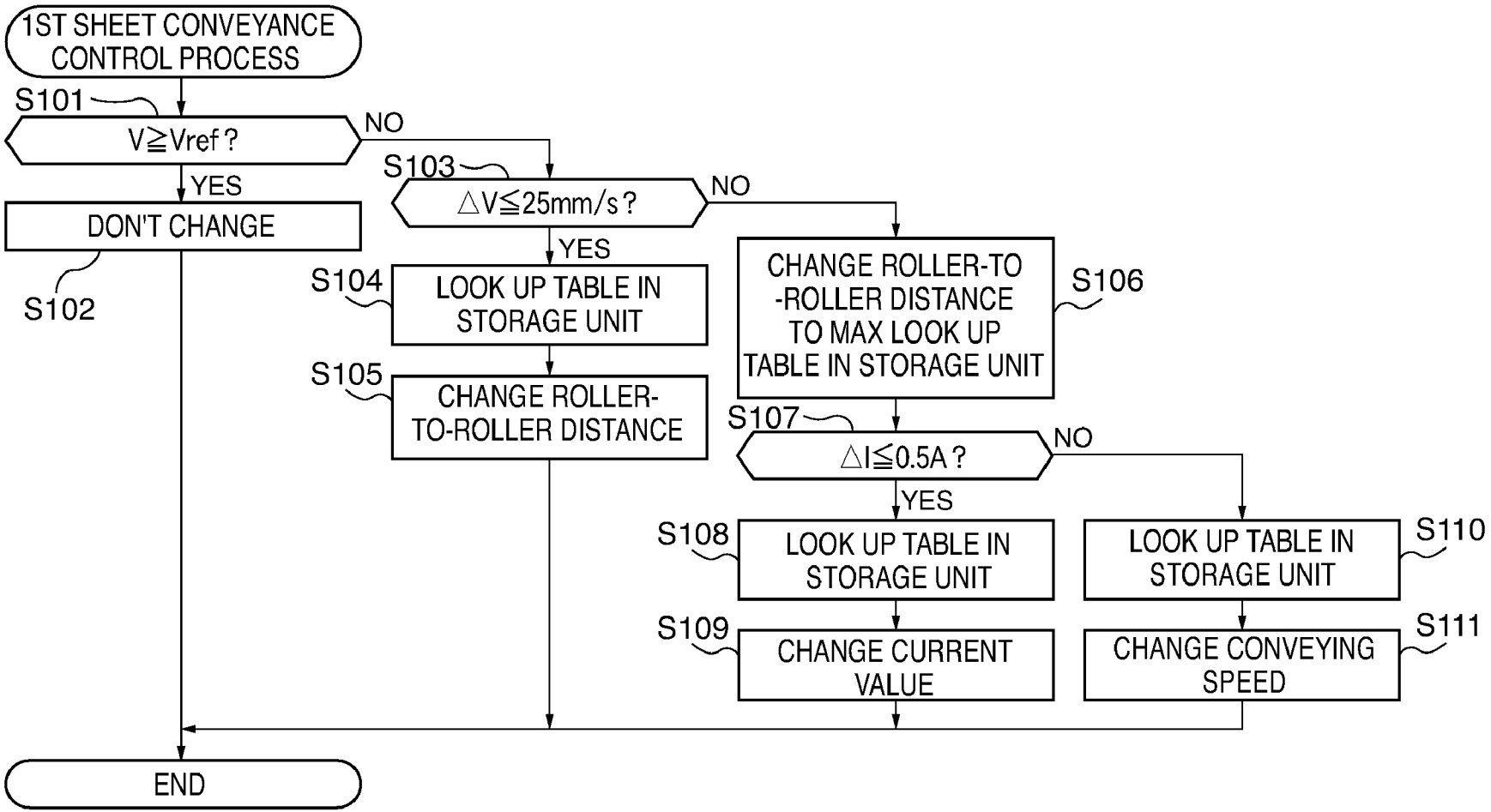
FIG. 15 is a flowchart of a first sheet conveyance control process carried out based on the first control method by the control circuit.

FIG. 15 is a flowchart of a first sheet conveyance control process carried out by the control circuit (CPU 301) in FIG. 12 based on the first control method.

As shown in FIG. 15, after the start of sheet feeding, it is determined in a step S101 whether or not a speed V detected from the encoder 203 mounted to the roller pair 201 when the leading end of a sheet S gets caught in the roller pair 201 is not smaller than the threshold value Vref.

If the speed V detected from the encoder 203 is not smaller than the threshold value Vref, it is determined that an impact caused when the leading end of the sheet S got caught in the roller pair 201 was small, and future sheet feeding under the present setting is permitted (step S102). If it is determined in the step S101 that the speed V is smaller than the threshold value Vref, the process proceeds to a step S103, wherein it is determined whether or not the speed change amount ΔV (Vref−) is not larger than 25 mm/s. If the answer to this question is affirmative, the process proceeds to a step S104.

In the step S104, a value of setting stored in the memory 303 is selected and set, and in a step S105, the nip pressure-adjusting motor 207 is controlled using the set value, so as to change the distance between the two rollers of the roller pair 201 (step S105).

On the other hand, if it is determined in the step S103 that the speed change amount ΔV (Vref−) is larger than 25 mm/s, the process proceeds to a step S106, wherein the distance between the two rollers of the roller pair 201 is changed to its maximum value. Then, the associated table is looked up, and the process proceeds to a step S107, wherein it is determined whether or not the change amount of the current value of the conveying motor 206 stored in the memory 303 is not larger than 0.5 A.

If it is determined in the step S107 that the change amount of the current value of the conveying motor 206 stored in the memory 303 is not larger than 0.5 A, the process proceeds to a step S108, and then the current value is changed (step S109).

On the other hand, if it is determined in the step S107 that the change amount of the current value of the conveying motor 206 is larger than 0.5 A, the process proceeds to a step S110. In the step S110, the associated table is looked up, and then the speed of the conveying motor 206 is changed in a step S111, followed by terminating the present process.

The numerical values used in the present flowchart are mentioned only by way of example, and therefore different apparatuses may use different reference values. Further, although in FIG. 15, if the speed V detected from the encoder 203 when the leading end of a sheet S gets caught in the roller pair 201 becomes smaller than the threshold value Vref, the roller-to-roller distance, the current value of the conveying motor 206, and the speed of the same are changed in the mentioned order, only the current value may be changed, or alternatively, only the speed may be changed.

Figure 16:
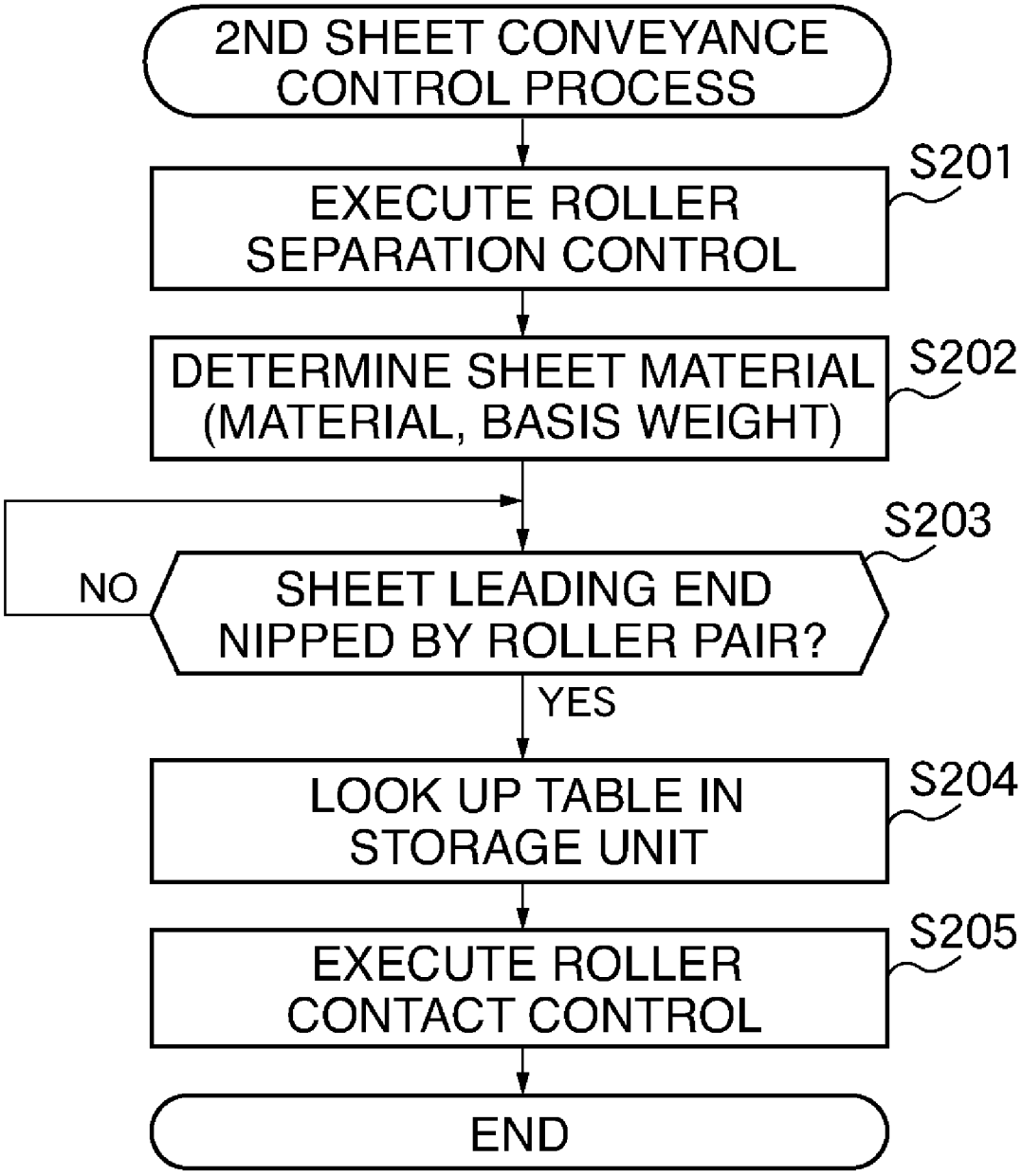
FIG. 16 is a flowchart of a second sheet conveyance control process carried out based on the second control method by the control circuit.

FIG. 16 is a flowchart of a second sheet conveyance control process based on the second control method carried out by the control circuit (CPU 301) in FIG. 12.

Referring to FIG. 16, after the start of sheet feeding, control for separating the two rollers of the roller pair 201 from each other is executed in a step S201. The separation of the two rollers of the roller pair 201 may be performed at a time point when the leading end of a sheet S blocks light to the first sensor 208, or before the time point.

Then, the material or basis weight of the sheet S to be conveyed is determined in a step S202. This determination may be performed based on information input by an input unit for inputting the information on the material of the sheet S or based on information detected by a material detecting unit, not shown.

If it is determined in a step S203 that the leading end of the sheet S has been nipped by the roller pair 201, a table prepared according to the material of the sheet S to be conveyed and stored in the memory 303 is looked up (step S204). Then, contact control of the two rollers of the roller pair 201 is started (step S205), followed by terminating the present process.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2006-352938 filed Dec. 27, 2006, which is hereby incorporated by reference herein in its entirety.

What is claimed is:

1. A sheet conveying device comprising:

a conveying roller pair configured to nip and convey a sheet;

a driving unit configured to drive said conveying roller pair;

a rotational speed-detecting unit configured to detect a rotational speed of said conveying roller pair;

a pressure control unit configured to control a nip pressure of said conveying roller pair; and a main control unit configured to control said pressure control unit according to a change in the rotational speed of said conveying roller pair detected by said rotational speed-detecting unit during sheet conveyance;

wherein said main control unit is operable when a nip pressure to be controlled by said pressure control unit is outside a controllable range, to perform control such that a driving force of said driving unit is increased.

2. A sheet conveying device as claimed in claim 1, wherein said main control unit is operable when said rotational speed-detecting unit detects that the rotational speed of said conveying roller pair has become lower than a predetermined rotational speed, during sheet conveyance, to control said pressure control unit in a direction in which the nip pressure is reduced.

3. A sheet conveying device as claimed in claim 1, comprising a storage unit configured to store information on a nip pressure of said conveying roller pair for sheet conveyance, on a sheet type-by-sheet type basis, and wherein said main control unit controls said pressure control unit such that said conveying roller pair provides the nip pressure the information on which is stored in said storage unit, according to a sheet type of the sheet being conveyed.

4. A sheet conveying device as claimed in claim 3, wherein said main control unit is operable after the sheet is nipped by said conveying roller pair, to perform control such that the nip pressure controlled by said pressure control unit is changed according to a type of the sheet.

5. A sheet conveying device as claimed in claim 1, wherein said main control unit is operable before or after the sheet is nipped by said conveying roller pair, to perform control such that the nip pressure controlled by said pressure control unit is changed.

6. A sheet conveying device as claimed in claim 5, comprising an operating screen, and wherein said main control unit performs control such that productivity is displayed on said operating screen.

7. An image forming apparatus comprising a sheet conveying device, wherein the sheet conveying device comprises:

a conveying roller pair configured to nip and convey a sheet;

a driving unit configured to drive said conveying roller pair;

a rotational speed-detecting unit configured to detect a rotational speed of said conveying roller pair;

a pressure control unit configured to control a nip pressure of said conveying roller pair; and a main control unit configured to control said pressure control unit according to a change in the rotational speed of said conveying roller pair detected by said rotational speed-detecting unit during sheet conveyance;

wherein said main control unit is operable when a nip pressure to be controlled by said pressure control unit is outside a controllable range, to perform control such that a driving force of said driving unit is increased.

* * * * *